US009257062B2

(12) United States Patent
Molenaar et al.

(10) Patent No.: US 9,257,062 B2
(45) Date of Patent: Feb. 9, 2016

(54) TRANSPORTABLE SIGN

(75) Inventors: Stephan Douwe Constantijn Molenaar, 's-Gravenhage (NL); Philip Nicolaas Ramondt, Voorburg (NL)

(73) Assignee: IMAGE BUILDING HOLDING B.V., 's-Gravenhage (NL)

( * ) Notice: Subject to any disclaimer, the term of this patent is extended or adjusted under 35 U.S.C. 154(b) by 99 days.

(21) Appl. No.: 13/182,729

(22) Filed: Jul. 14, 2011

(65) Prior Publication Data

US 2013/0014414 A1 Jan. 17, 2013

(51) Int. Cl.
*G09F 7/00* (2006.01)
*G09F 15/00* (2006.01)

(52) U.S. Cl.
CPC ..... *G09F 15/0062* (2013.01)

(58) Field of Classification Search
USPC ..... 40/601, 607.03, 607.04, 586; 248/188.5
See application file for complete search history.

(56) References Cited

U.S. PATENT DOCUMENTS

| | | | | |
|---|---|---|---|---|
| 2,840,942 | A * | 7/1958 | Ryan | 40/614 |
| 4,353,179 | A | 10/1982 | Jennings | |
| 4,572,510 | A * | 2/1986 | Green | 273/148 R |
| 5,701,695 | A * | 12/1997 | Current | 40/606.14 |
| 6,047,935 | A * | 4/2000 | Wright | 248/237 |
| 7,000,344 | B2 | 2/2006 | Furlan et al. | |
| 7,207,128 | B2 * | 4/2007 | Cook | 40/603 |
| 2010/0018097 | A1 | 1/2010 | Xu | |

FOREIGN PATENT DOCUMENTS

| | | |
|---|---|---|
| EP | 2105907 A2 | 9/2009 |
| GB | 2244586 | 12/1991 |
| WO | 0175849 | 10/2001 |
| WO | 2009009904 | 1/2009 |

OTHER PUBLICATIONS

European Search Report, mailed May 3, 2011 in connection with European Patent Application No. 11150920.4.

* cited by examiner

*Primary Examiner* — Joanne Silbermann
(74) *Attorney, Agent, or Firm* — Steven M. Koehler; Westman, Champlin & Koehler, P.A.

(57) ABSTRACT

A transportable sign (1) is provided which comprises a base portion (3), a support portion (5), and a display portion (7), In the sign, the display portion comprises a carrier (9) configured to carry a display medium (11) to display an image (13), e.g. a board, a cloth or a sail etc. The base portion is configured to position the sign supporting the support portion and the display portion, and the support portion is configured to support the display portion, when mounted to or on the base portion. In the sign, the display portion is mounted or mountable to the support portion to form a transformable assembly such that, when mounted to the base portion, the display portion is positionable in and movable between at least a first, relatively high, position and a second, relatively low, position with respect to the base portion.

21 Claims, 6 Drawing Sheets

TRANSPORTABLE SIGN

TECHNICAL FIELD

The present disclosure relates to signs, in particular to signs for displaying advertisements, more in particular to transportable signs for temporary advertising.

BACKGROUND

In the field of advertising there is a strong and marked division between permanent signs and temporary signs.

Permanent signs are generally relatively large objects and are fixed in position substantially permanent, e.g. for remaining in place for several years and sometimes up to several decades. Such signs are mounted to large counterweights. In view of the intended long periods of use, local governments, e.g. city councils or municipalities, tend to allow such signs sparingly and tend to have extensive procedures for obtaining a permit to place the sign. For economical exploitation of the sign prolonged contracts with advertisers may be required; an empty sign gives a poor impression to viewers and allowing an advertisement to be displayed for longer periods than initially agreed may reduce market value of advertising campaign and/or the sign operator. Permanent signs may be integrated in permanent objects such as divider cabinets for electrical or water mains supplies and/or public transport stop shelters.

Temporary signs provide the benefit of allowing the sign to be put up when required e.g. when a campaign is started and removed when the campaign is ended. Thus a certain surprise effect is provided to the advertisement. Typical examples of temporary advertisement campaigns are product introductions, temporary exhibitions, seasonal actions and elections. A temporary sign may be removed when the advertisement area is not sold or rented so that empty signs are prevented. Temporary signs further usually require "lighter" permits which may be handed out easier than permits for permanent signs.

An important aspect for temporary signs is to find a trade-off between economic factors as portability for transport and/or storage, time required for erecting the sign and/or putting up the display image, and more technical factors such as stability and robustness of the sign and public acceptability and aesthetics. For economic viability of temporary advertising, transportable signs usually are constructed from wooden boards and beams, with concrete blocks as counterweights. Another strategy, which has been initiated by the present applicant, is to use modular construction units such as used for scaffolding to erect a frame, and providing the frame with a board or cloth which carries the image to be displayed or which is to be provided with an advertisement image sheet e.g. a poster. Such previous transportable signs have limited aesthetic value, which prevents their use with some high level advertisements, e.g. high class art, cars and jewellery. They further may take significant time in manufacturing, erection and taking down. Further, the signs are not suitable for being transported in erected/assembled state, such that the signs themselves are not readily transportable.

A major concern for temporary signs is the construction of the sign for purposefully erecting it for a temporary campaign and deconstruction and storage of it afterwards. As a consequence, exchanging a display image tends to be complicated and thus time consuming and potentially dangerous for the operator. For working at an elevation higher than about 3 m, which is typically applicable for (putting up or exchanging) advertisement signs, recent laws forbid the use of ladders and instead prescribe the use of raised podia or cherry pickers.

This significantly increases the time and costs for erecting and exploitation of temporary displays.

SUMMARY

In view of the above, there exists a strong desire for a temporary sign addressing one or more of the above-described problems.

To that end, a transportable sign is provided which comprises a base portion, a support portion, and a display portion, In the sign, the display portion comprises a carrier configured to carry a display medium to display an image, e.g. a board, a cloth or a sail etc. The base portion is configured to position the sign, supporting the support portion and the display portion, and the support portion is configured to support the display portion, when mounted to or on the base portion. In the sign, the display portion is mounted or mountable to the support portion to form a transformable assembly such that, when mounted to the base portion, the display portion is positionable in and movable between at least a first, relatively high, position and a second, relatively low, position with respect to the base portion.

Such sign facilitates applying and/or exchanging the display medium, since the working height of the display portion may be lowered. Having the display portion positionable in at least a first, relatively high, position and a second, relatively low, position allows to arrange the display portion in a desired position for a particular campaign, and/or to adapt the sign to varying surroundings. Thus versatility of the sign is improved. If desired the display portion may be temporarily positioned in the second, relatively low, position to reduce the wind-sensitivity of the sign in cases of storm where the sign is otherwise in the first position for the campaign. In this way the sign may be realised lighter-weight than otherwise required since the arm of the wind force acting on the display portion is shortened. This further improves portability of the sign. Further, with the display portion in the first position, portability of the sign is improved and storing is facilitated.

Versatility and adaptability of the sign is further improved if the display portion is positionable in and movable between a plurality of positions in between the first position and the second position, preferably substantially continuously.

Versatility of the sign is further improved when the display portion is provided with an exchangeable image display medium. Exchanging the advertisement image is facilitated when the display portion is configured such that the display medium is exchangeable in the second position. In particular when in the second position the display portion does not exceed about 3 m height the image medium may be exchanged by an operator without legally requiring a raised podium or a cherry picker; an operator may use more common and manoeuvrable means of transportation such as a regular car or a minivan.

Public acceptance and robustness may be improved if the display portion and the support portion comprise cooperating displacement means which are hidden from sight by the display portion and the support portion in at least the first position and the second position.

Transportability and versatility are further improved if at least the support portion is releasably mounted or mountable to the base portion, such that the sign may be disassembled before transport. In addition, this facilitates quick repair of the sign by partial replacement.

The base portion may comprise a coupling portion for coupling with a hoisting arrangement, such that at least the base portion, preferably also the support portion and/or the assembly of support portion and display portion, are transportable and displaceable when supported from that coupling portion by the hoisting arrangement. Also or alternatively, the support portion and/or the display portion may comprise a coupling portion for coupling with a hoisting arrangement, such that at least the display portion, preferably also the support portion and/or the assembly of support portion and display portion, more preferably the entire transportable sign, are transportable and displaceable when supported from that coupling portion by the hoisting arrangement. One or more portions may be displaced and/or placed onto or from a lorry or the like for transportation and/or maintenance.

Since the sign may be placed on different surfaces and locations, it is beneficial if the base portion is provided with at least one levelling prop which is height-adjustable with respect to the base portion. Height adjustment is efficiently and reliably realised if the levelling prop is screwable with respect to the base portion.

The levelling prop may comprise a support end at one end arranged at a bottom side of the base portion and a connection end or coupling end at another end arranged towards a top side of the base portion and operable from the top side of the base portion. In such case adjusting the levelling prop is facilitated. An operator need not access the levelling prop underneath the base portion such that operator safety is improved.

The connection end of the levelling prop may comprise a coupling for coupling to an operating tool for adjusting the levelling prop. This allows to remove the operating tool, reducing costs, and further it reduces options for vandalism.

In the transportable sign, the base portion may have dimensions of about 0.2-0.5 m (height)×2-3 (length) m×2-3 m (width), and the display portion (7) may have dimensions of about 2-3 m (height)×2-4 m (width)×0.3-0.7 m (depth) and the assembly (8) may have a dimension of about 2.5-3 m height including the support portion (5) at minimal extension. Such sizes allow convenient transportation of a plurality of signs and may provide a generally aesthetically pleasing sign.

BRIEF DESCRIPTION OF THE DRAWINGS

The disclosure will hereafter be more fully explained with reference to the drawings showing an embodiment of the disclosure by way of example.

It is noted that the drawings are schematic, not necessarily to scale and that details that are not required for understanding the present disclosure may have been omitted. The terms "upward", "downward", "below", "above", and the like relate to the embodiments as oriented in the drawings unless stated otherwise. Further, elements that are at least substantially identical or that perform an at least substantially identical function are denoted by the same numeral.

DETAILED DESCRIPTION OF EMBODIMENTS

Figure 1:
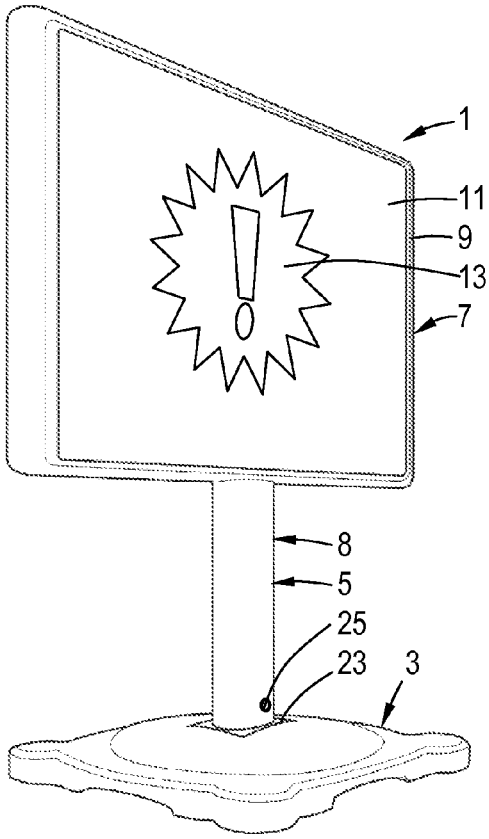
FIGS. 1 and 2 are perspective views of a transportable sign in a first configuration and a second configuration, respectively.

Referring in particular to FIGS. 1-6, a sign 1 is shown, comprising a base portion 3, a support portion 5 and a display portion 7. The support portion 5 and the display portion 7 are mounted together to form an assembly 8. The display portion 7 comprises a carrier 9 which is configured to carry a display medium 11 to display an image 13.

The carrier 9 here comprises a frame 9A extending substantially along the circumference of the display portion 7 and which comprises means 9B-9C for fastening and holding the display medium 11. The carrier 9 comprises covers 10 to hide the frame and edge portions of the display medium 11 from weather influences, view and/or vandalism. The covers 10 may be disconnectable from or displaceable with respect to the frame 9 for exchanging the display medium 11, possibly operable with a lever, a lock 10A or a similar device which may be accessible from an opposite side of the cover.

Figure 6:
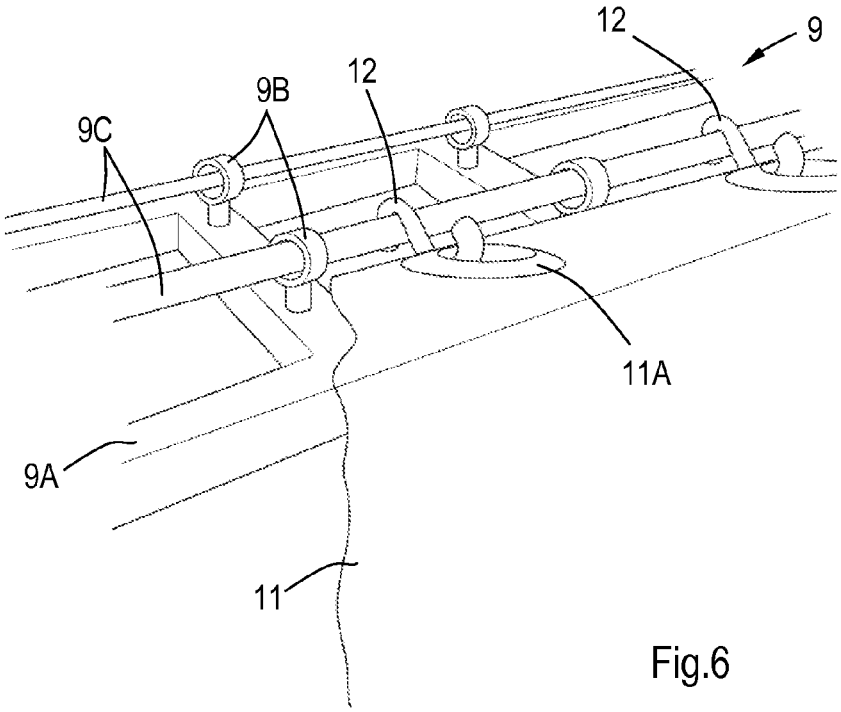
FIG. 6 is a detail showing a way of mounting a display medium.
Figure 7:
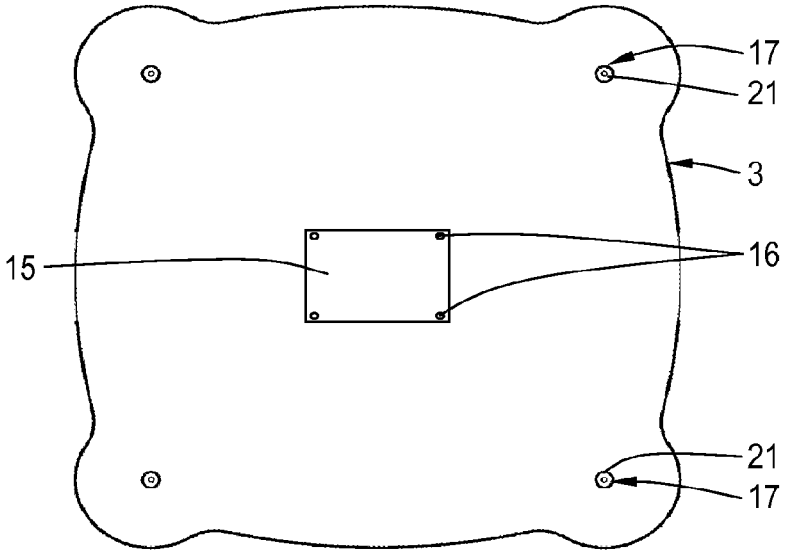
FIG. 7 is a top view and FIG. 8 is a bottom view of a base portion of the sign of FIG. 1.
Figure 8:
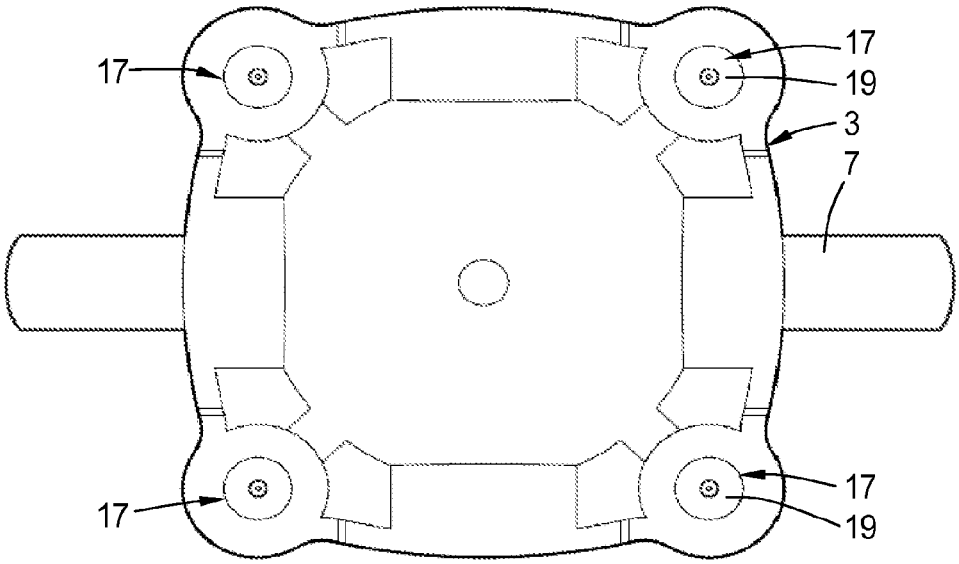

In a typical example, the frame 9 comprises a plurality of hook portions and the display medium 11 comprises a tarp or cloth printed with an image 13 and provided with one or more eyelets 11A, loops and/or elastic bands or lines around its border which are attachable to the hook portions of the frame in a manner well known in the art. Alternatively, the frame 9 and/or the display medium 11 may comprise a plurality of push buttons, toggles and/or twist buttons or any other cooperating fasteners. In FIG. 6 an embodiment is shown wherein the frame 9 comprises eyes 9A holding an elastic band 9B. The display medium 11 is attacked to the frame 9 with hooks 12 connecting eyelets 11A to the elastic band 9B. The base portion 3 is shown in more detail in FIGS. 7 and 8. The base portion 3 is a substantially broad and heavy object, e.g. a concrete block and/or a water- or sand-filled closed or closable container, to form a stable stand for positioning the sign and to form a counterweight to counteract forces such as wind forces acting on the display portion 7. The base portion 3 comprises a mounting portion 15 provided with screw portions 16 for mounting the support member 5 to the base portion 3 and one or more, here four, levelling props 17. Here, the levelling props 17 have a disc-shaped foot portion 19 and a threaded stem portion 21 extending in a corresponding threaded portion in the base portion 3. The foot portion 19 or the stem portion 21 may comprise a coupling portion for coupling with a tool such that the length of the levelling prop 17 below the base portion 3 is adjustable by screwing the levelling prop 17 in or out. Here, the stem portion 21 comprises a coupling portion which is accessible from the top side of the base portion 3 such that an operator need not put a tool and/or a limb underneath the base portion 3.

The support portion 5, which here is in the form of one column or pillar, is mounted to the base portion 3 to support the display portion 7. For such mounting, and as shown here, the support portion 5 may comprise a flange 23 to be fastened to the base portion 3, e.g. with screw bolts 16. Screw bolts 16 may be fastened to and/or integrated in the base portion 3 and the flange 23 may comprise matching through holes such that the support portion is releasably mountable to the base portion 3 with nuts fitting the screw bolts 16. Also or alternatively, the base portion 3 may comprise one or more internally threaded portions for receiving a screw bolt through or from (the flange 23 of) the support portion 5. Other ways of mounting the support portion 5 to the base portion 3 such as welding, clamping and/or integration with a portion of the base portion 3 are also conceivable.

Figure 2:
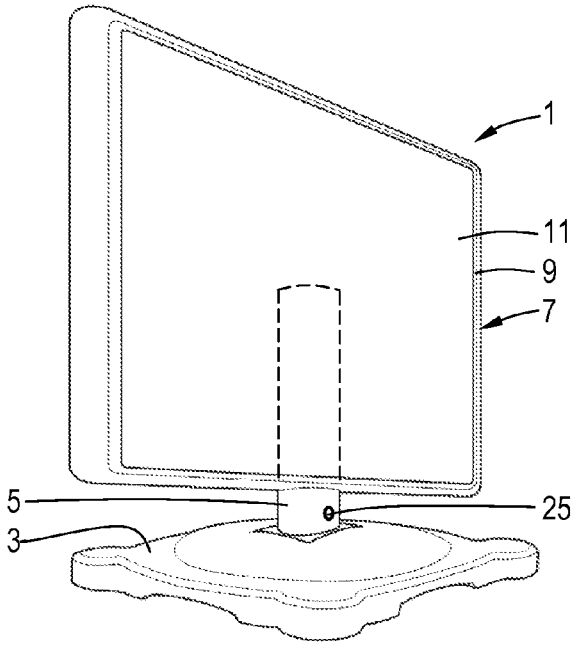
Figure 3:
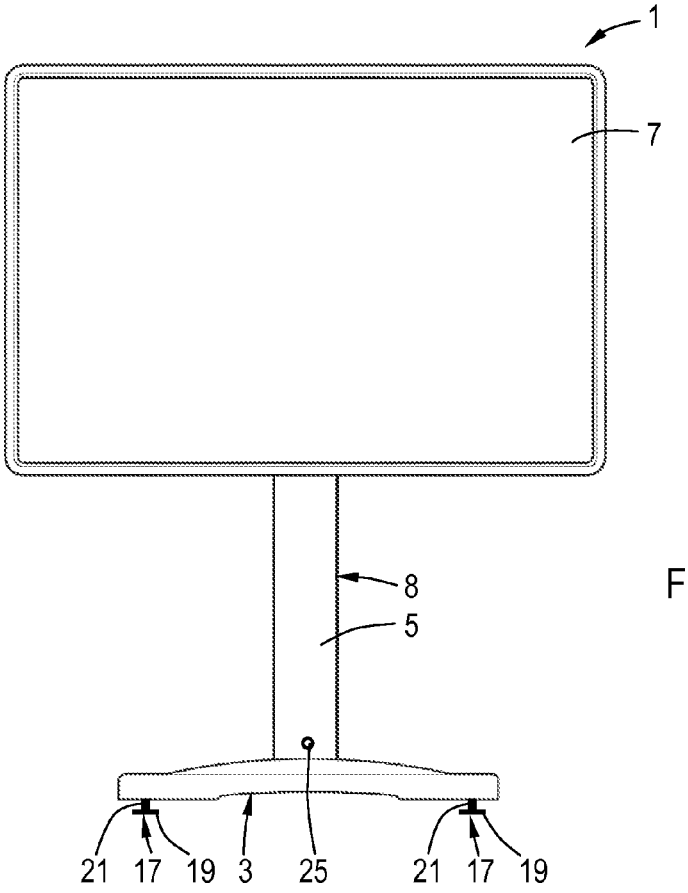
FIGS. 3 and 4 are front views of the sign of FIG. 1 in the first configuration and the second configuration, respectively.
Figure 4:
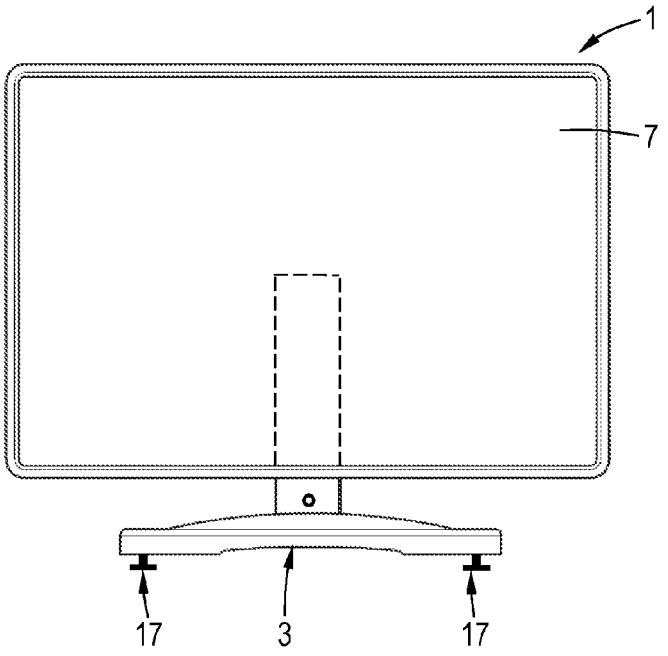
Figure 5:
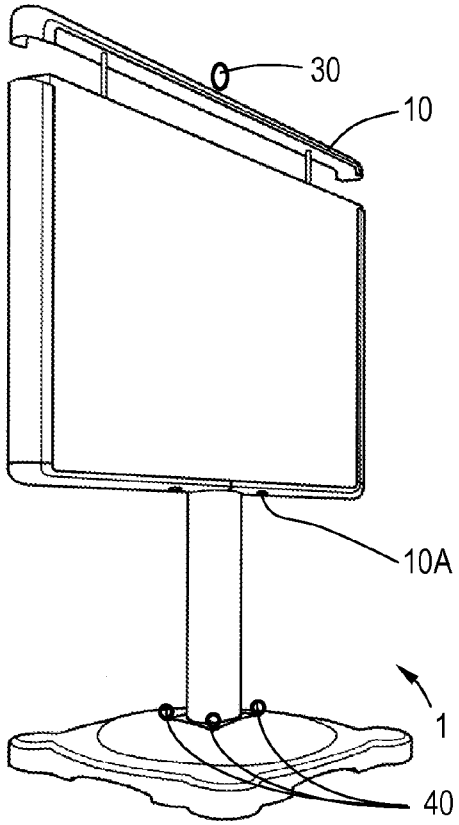
FIG. 5 is a perspective view of an alternative embodiment.

As shown in FIGS. 1-6, the display portion 7 is mounted to the support portion 5 forming at least a portion of a transformable assembly 8. In the assembly 8 the display portion 7 is positionable in and movable between a first, relatively high, position with respect to the base portion 3 to provide a first configuration of the sign (FIGS. 1 and 3) and a second, relatively low, position respect to the base portion 3 to provide a second configuration of the sign (FIGS. 2 and 4). In the first configuration visibility of the sign 1 from afar is increased. In the second configuration, accessibility of the display portion 7, e.g. for cleaning, exchange and/or maintenance is increased and wind exposure is decreased. Depending on a displacement mechanism—see below—the display portion 7 may be positionable at any position in between the first and second positions. Here, the display portion 7 partially envelops the support portion 5, both in the first and second configurations (see dashed lines in FIGS. 2 and 4). The sign 1 thus appears integral and pleasing at both configurations and with the display portion in between the first and second positions.

At a given position, e.g. in the second configuration the image 13 may be presented substantially at eye-level of a target public. A display arrangement which comprises plurality of substantially identical signs 1 which are arranged in a series or array with the display portions 7 positioned at mutually different heights, e.g. increasingly higher or lower along the series or the array, may provide added impact and/or dramatic value to the display arrangement and a campaign.

Figure 9:
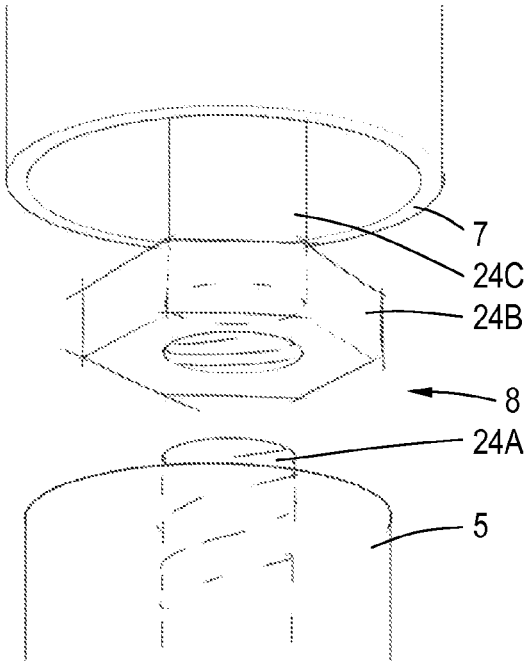
FIG. 9 is a partial explosion view of displacement means and FIG. 10 shows a method of operating the displacement means.

The display portion 7 and the support portion 5 may be mounted together in various suitable ways and comprise various cooperating displacement means to form (a portion of) the transformable assembly 8. Suitable cooperating displacement means are hydraulic and/or pneumatic cylinders, folding or scissoring jacks, a hoisting arrangement with a cable (e.g. steel cable) and/or a chain etc. Advantageously, as shown in FIG. 9 one of the support and display portions 5, 7, here the support portion 5, comprises a threaded spindle 24A and the other portion 7, 5, here the display portion 7, comprises a cooperating threaded portion or nut portion 24B, here mounted on a tube portion 24C. Upon rotating the spindle 24A the nut portion 24B is displaceable substantially continuously. The tube portion 24C may provide a guide to the spindle 24A, e.g. against shaking during transportation of the sign 1.

Figure 10:
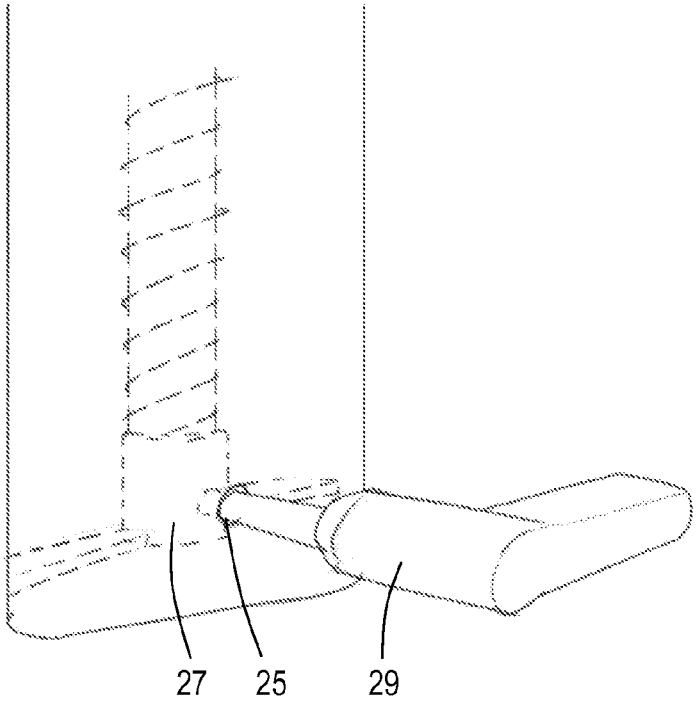

For facilitating operation of the displacement means to bring the sign 1 in a configuration for maintenance and/or exchange of (a portion of) the display medium, e.g. the second configuration shown in FIGS. 2 and 4, a coupling 25 for an operating tool may be provided, which is accessible from outside a cover hiding the displacement means from view. The coupling 25 may be covered with a lockable cover against weather influence and/or unauthorised access. Advantageously and as indicated in FIG. 10, the displacement means comprise a gear assembly 27 such that with little effort the display portion is displaceable, e.g. with a hand crank or a battery operated power tool 29 coupled with the coupling 25. The sign 1 may also be provided with motorised displacement means.

The coupling of the support portion 5 to the display portion 7, and of the support portion 5 to the base portion 3 may be such that the sign 1 is substantially robust to environmental influences. E.g., the support portion 5 may be broadened and/or asymmetric to prevent rotation of the display portion 7 about the support portion 5.

The sign 1 is transportable with a hoisting or lifting arrangement, but not by hand so that it is substantially wind and vandalism-proof. The versatility of the sign 1 is such that it may be erected in and be adapted to various positions and configurations. To further facilitate transport and placement of the sign 1, the support portion 5 and/or display portion 7 comprises a coupling portion for coupling with a hoisting arrangement, e.g. one or more hoisting eyes (30) or hooks. The coupling portions may be covered and hidden from view by (the covers of) the carrier 9 of the display portion 7 after positioning the sign. The coupling portions may be configured such that entire sign 1, including the base portion 3, may be supported from it. The base portion 3 may also comprise one or more coupling portions. Advantageously, the screw bolts 16 and/or threaded holes of the mounting portion 15 are configured such that one or more suitable coupling means such as screw eyes (40) and/or hooks attached to the bolts 16 or holes may provide sufficient strength for supporting from them the base portion 3, possibly together with the assembly 8.

For placing the sign 1 at a desired location the sign 1 is put on a suitable vehicle, e.g. a cart, a trailer or a lorry, and transported to the desired location. For facilitating transport, the assembly 8 and the base portion 3 may be unmounted and transported as separate objects 3, 5, 7 or 3, 8. Where appropriate, the assembly 8 may be brought into a configuration of minimum external volume, e.g. as in the second configuration of the sign 1 shown in FIGS. 2 and 4. At the desired location the base portion 3 is transported, e.g. hoisted from the vehicle to the predetermined position. The base 3 is positioned level and stable by adjustment of the levelling props 17. This may be done with the base portion 3 (partially) suspended from hoisting arrangement. Next the assembly 8 is mounted to the base portion 3 or where appropriate the support portion 5 and the display portion 7 are individually mounted to the base member 3 and each other, respectively, to assemble the sign 1. Before or after assembling the sign 1 the display medium 11 and/or an image 13 may be provided to the display portion 7, and the display portion 7 placed in a desired position to provide a sign 1 in the desired configuration.

Figure 11:
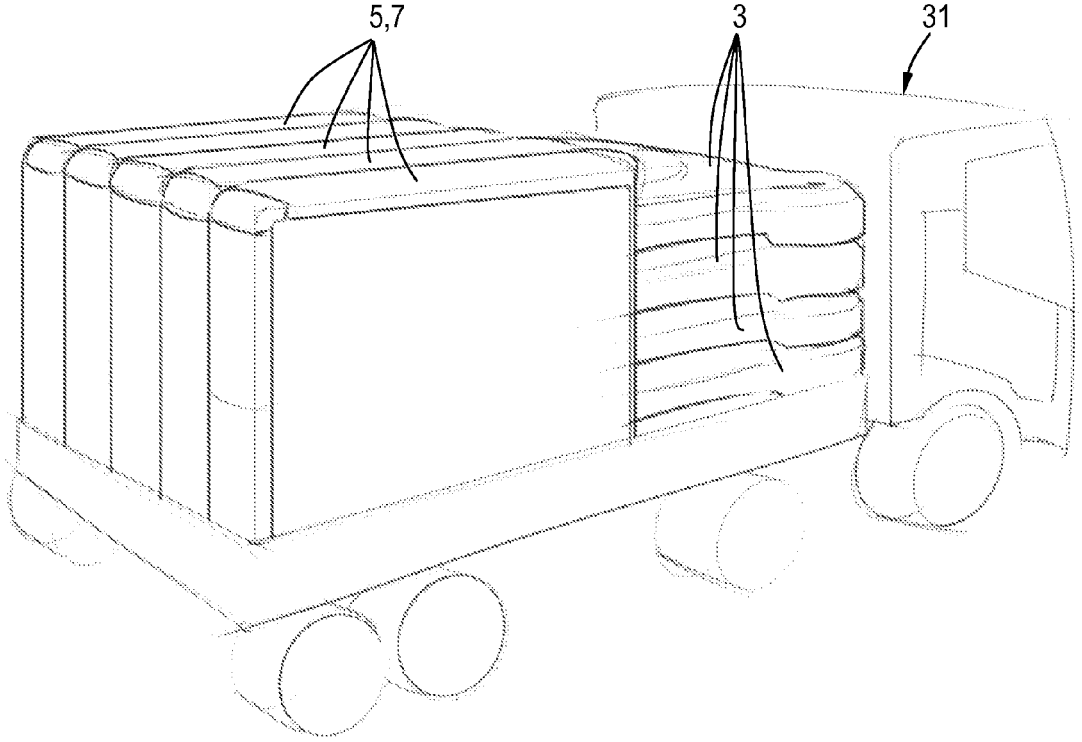
FIG. 11 indicates a method of transporting five signs.

Placing a sign 1 may thus be performed quite efficiently and fast compared to erecting a scaffolding and/or a wooden board structure. Operator time is thus significantly reduced, reducing costs for employing and maintaining the sign 1. Such portability of the sign 1 also allows to manufacture the sign 1 in durable materials, extending their longevity. Selecting the size(s) of the sign and/or its constituting portions such that a plurality of the signs, e.g. five signs as shown in FIG. 11, may be transported on a single small or medium-sized lorry 31, e.g. a twenty-four-tonne lorry with a load carriage capacity of about twelve tonnes increases versatility of the sign; such lorries may be relatively well manoeuvrable and may be allowed in municipal and/or city centres such that an efficient route may be designed along different locations were the signs are to be erected. A single route may be used to place the plurality of signs. Preferably, the lorry 31 comprises an integrated crane or other hoisting arrangement for transporting the signs of the lorry bed. It has been considered that placing five of the described signs, each having a base portion of about 0.2-0.5, preferably about 0.30 m high, and about 2-3 m wide per direction, e.g. about 2.4 by 2.4 m wide and weighing about 1-3 tonne, e.g. about 2 tonne and a size of the display portion of about 2-3 m, advantageously just under 3 m such as about 2.7 m high and 2-4 m, advantageously just under 4 m such as about 3.7 m wide and about 0.3-0.7 m, e.g. about 0.4-0.5 m, and somewhat less than 3 m, e.g. about 2.8 m height including the support portion at minimum extension (size of assembly 8 minimised), along an average city route by a lorry 31 comprising a crane may take two people about half a day without having to return to a depot for picking up additional signs. Thus, about ten signs may be placed in an average working day. With the mentioned values and the design as shown in the Figures an aesthetically pleasing and conveniently sized sign is provided. Maintenance and/or exchanging of a fitting display medium or image at an industry standard size of about 8.8 square meters may be done by a single worker within about 15 minutes per sign. Of course, other sizes may be employed as well as desired.

The above described factors allow investments into designing and forming the sign to be economically feasible and further improve the public and municipal acceptance of (placing) the sign 1. The signs 1 may be designed to be perceived as acceptable "street furniture" and to fit their environment and/or to be generally aesthetically pleasing. E.g., as shown in the Figs, portions of the sign 1, including the base portion 3, may be smoothly rounded off and may be coated with plastic and/or paint.

The disclosure is not restricted to the above described embodiments which can be varied in a number of ways within the scope of the claims. For instance the display portion may be substantially square, round, or have any other suitable shape. The display portion may provide plural faces to display an image and/or to be provided with exchangeable display media.

The displacement means may be visible. The support portion and the displacement means may be integrated, e.g. scissoring jack-type or hydraulic cylinder type and may be (partially) covered with a cover. A cover for the support portion may be a deformable, e.g. foldable, sleeve.

The base portion and the support portion may be an integral object.

The sign may comprise further display portions, e.g. a (possibly removable) fixed sign at a particular position on the support portion below the display portion.

Elements and aspects discussed for or in relation with a particular embodiment or variant may be suitably combined with elements and aspects of other embodiments and/or variants, unless explicitly stated otherwise.

The invention claimed is:

1. A transportable sign comprising a base portion, a support portion, and a display portion, wherein the display portion comprises a carrier configured to carry a display medium to display an image, wherein the base portion extends substantially perpendicular to the support portion and is configured to position the sign, by supporting the support portion and the display portion in a substantially upright position and providing the display medium a substantially vertical surface on which the image is disposed, wherein the support portion is configured to support the display portion, when mounted to or on the base portion;

wherein further the display portion is mounted or mountable to the support portion to form a transformable assembly such that, when mounted to the base portion, the display portion is positionable in, and movable over the support portion between, at least a first, relatively high, position and a second, relatively low, position with respect to the base portion, the display portion enveloping the top portion of the support portion in at least the first and second positions, the carrier extending substantially along a circumference of the display portion, and the support portion extending into a space defined by the carrier and by the display medium when the display medium is carried on or in the carrier in at least the first and second positions; and wherein when the transformable assembly is mounted to the base portion, and the base portion is disposed on a substantially horizontal surface, the display medium comprises a substantially vertical surface on which the image is disposed.

2. The transportable sign of claim 1, wherein the display portion is positionable in and movable between a plurality of positions in between the first position and the second position.

3. The transportable sign of claim 1, wherein the display portion is provided with an exchangeable and/or replaceable display medium.

4. The transportable sign of claim 3, wherein the display portion is configured such that the display medium is exchangeable in at least the second position.

5. The transportable sign of claim 1, wherein, in the second position, the display portion does not exceed about 3 m height.

6. The transportable sign of claim 1, wherein the support portion and the display portion comprise cooperating displacement means which are hidden from sight by at least one of the display portion and the support portion in at least the first position and the second position of the display portion.

7. The transportable sign of claim 1, wherein the display portion envelops the top portion of the support portion such that the top portion is hidden from sight by the display portion and/or the support portion in at least the first position and the second position of the display portion.

8. The transportable sign of claim 1, wherein at least the support portion is releasably mounted or mountable to the base portion.

9. The transportable sign of claim 1, wherein the base portion comprises a coupling portion for coupling with a hoisting arrangement, such that at least the base portion is transportable and displaceable when supported from that coupling portion by the hoisting arrangement.

10. The transportable sign of claim 9, wherein the base portion comprises the coupling portion for coupling with a hoisting arrangement, such that the base portion and/or an assembly of support portion and display portion, are transportable and displaceable when supported from that coupling portion by the hoisting arrangement.

11. The transportable sign of claim 1, wherein at least one of the support portion and the display portion comprises a coupling portion for coupling with a hoisting arrangement, such that at least the display portion is transportable and displaceable when supported from that coupling portion by the hoisting arrangement.

12. The transportable sign of claim 11, wherein at least one of the support portion and the display portion comprises the coupling portion for coupling with a hoisting arrangement, such that an assembly of support portion and display portion is transportable and displaceable when supported from that coupling portion by the hoisting arrangement.

13. The transportable sign of claim 11, wherein at least one of the support portion and the display portion comprises the coupling portion for coupling with a hoisting arrangement, such that the sign is transportable and displaceable when supported from that coupling portion by the hoisting arrangement.

14. The transportable sign of claim 1, wherein the base portion is provided with at least one levelling prop which is height-adjustable with respect to the base portion.

15. The transportable sign of claim 14, wherein the at least one levelling prop comprises a support end at one end arranged at a bottom side of the base portion and a connection end at another end arranged towards a top side of the base portion and operable from the top side of the base portion.

16. The transportable sign of claim 15, wherein the connection end of the levelling prop comprises a coupling for coupling to an operating tool for adjusting the levelling prop.

17. The transportable sign of claim 1, wherein the base portion has dimensions of about 0.2-0.5 m (height) ×2-3 (length) m×2-3 m (width), and the display portion has dimensions of about 2-3 m (height)×2-4 m (width) ×0.3-0.7 m (depth) and the assembly has a dimension of about 2.5-3 m height including the support portion at minimal extension.

18. The transportable sign of claim 1, wherein the carrier comprises a frame and covers, the frame extending substantially along the circumference of the display portion and comprising means for fastening and holding the display medium, the covers being arranged to hide the frame and edge portions of the display medium from weather influences, view and/or vandalism.

19. A transportable sign comprising a base portion, a support portion having a longitudinal axis, and a display portion, wherein the display portion comprises a carrier configured to carry an exchangeable and/or replaceable display medium comprising a generally planar surface to display an image disposed on the surface, the surface being parallel to the axis when the display medium is carried by the carrier, wherein the base portion extends substantially perpendicular to the support portion and is configured to position the sign, by supporting the support portion and the display portion in a substantially upright position and providing the display medium a substantially vertical surface on which the image is disposed, and wherein the support portion is configured to support the display portion, when mounted to or on the base portion;

wherein further the display portion is mounted or mountable to the support portion to form a transformable assembly such that, when mounted to the base portion, the display portion is positionable in, and movable over the support portion between, at least a first, relatively high, position and a second, relatively low, position with respect to the base portion, the display portion enveloping the top portion of the support portion in at least the first and second positions, the carrier extending substantially along a circumference of the display portion, and the support portion extending into a space defined by the carrier and by the display medium when the display medium is carried on or in the carrier in at least the first and second positions; and wherein when the transformable assembly is mounted to the base portion, and the base portion is disposed on a substantially horizontal surface, the display medium comprises a substantially vertical surface on which the image is disposed.

20. The transportable sign of claim 19, wherein the display portion is positionable in and movable between a plurality of positions in between the first position and the second position.

21. A transportable sign, comprising:

a base portion configured to position the sign; and a transformable assembly mounted to the base portion, the transformable assembly comprising:

a support portion; and a display portion having a carrier configured to carry a display medium to display an image and a frame extending substantially along a circumference of the display portion, the display portion mounted or mountable to the support portion, and when mounted to the base portion, positionable in, and movable over the support portion between at least a first, relatively high, position and a second, relatively low, position with respect to the base portion, the display portion enveloping the top portion of the support portion in at least the first and second positions and extending into a space inside the frame and behind the display medium when the display medium is carried on the carrier in at least the first and second positions; and wherein when the transformable assembly is mounted to the base portion, and the base portion is disposed on a substantially horizontal surface, the display medium comprises a substantially vertical surface on which the image is disposed.

* * * * *